US008380098B2

(12) United States Patent
Matsuno

(10) Patent No.: US 8,380,098 B2
(45) Date of Patent: Feb. 19, 2013

(54) FIXING DEVICE

(75) Inventor: Takuji Matsuno, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 250 days.

(21) Appl. No.: 12/729,694

(22) Filed: Mar. 23, 2010

(65) Prior Publication Data

US 2011/0052236 A1 Mar. 3, 2011

(30) Foreign Application Priority Data

Aug. 27, 2009 (JP) ..... 2009-197211

(51) Int. Cl.
*G03G 15/20* (2006.01)

(52) U.S. Cl. ..... 399/69

(58) Field of Classification Search ..... 399/69, 399/328

See application file for complete search history.

(56) References Cited

U.S. PATENT DOCUMENTS

| | | | | |
|---|---|---|---|---|
| 7,349,641 | B2 | 3/2008 | Ogashima | |
| 8,041,260 | B2 | 10/2011 | Yoshida | |
| 2004/0086295 | A1 | 5/2004 | Peng et al. | |
| 2005/0111863 | A1 | 5/2005 | Ogashima | |
| 2005/0163524 | A1 | 7/2005 | Shiobara et al. | |
| 2007/0154252 | A1 | 7/2007 | Yoshida | |
| 2010/0028036 | A1 * | 2/2010 | Aratachi et al. | 399/69 |

FOREIGN PATENT DOCUMENTS

| | | | |
|---|---|---|---|
| JP | SHO 62-2069 | | 1/1987 |
| JP | SHO 62-187373 | | 8/1987 |
| JP | HEI 2-193178 | | 7/1990 |
| JP | HEI 4-46376 | | 2/1992 |
| JP | 6-058815 | A | 3/1994 |
| JP | 6-194994 | A | 7/1994 |
| JP | 7-077888 | A | 3/1995 |
| JP | 8-095406 | A | 4/1996 |
| JP | 8-278721 | A | 10/1996 |
| JP | 8-305216 | A | 11/1996 |
| JP | 2002-156866 | A | 5/2002 |
| JP | 2003-57990 | | 2/2003 |
| JP | 2003-090763 | A | 3/2003 |
| JP | 2004-219619 | | 8/2004 |

(Continued)

OTHER PUBLICATIONS

Japanese Official Action dated Jun. 21, 2011 together with an English language translation from JP 2009-197211.

(Continued)

*Primary Examiner* — David Gray
*Assistant Examiner* — Erika J Villaluna
(74) *Attorney, Agent, or Firm* — Scully, Scott, Murphy & Presser, PC

(57) ABSTRACT

A fixing device for an electrophotographic image forming apparatus is provided with a heat roller configured to heat a toner image formed on a sheet, and a thermistor arranged opposite to a circumferential surface of the heat roller and configured to detect a temperature of the circumferential surface of the heat roller without contacting the heat roller. The thermistor is located at a position above a horizontal plane including a rotational axis of the heat roller and on a downstream side, in a rotational direction of the heat roller, with respect to a vertical plane including the rotational axis of the heat roller, and closer to the vertical plane than the horizontal plane.

7 Claims, 4 Drawing Sheets

FOREIGN PATENT DOCUMENTS

| | | |
|---|---|---|
| JP | 2005-156686 | 6/2005 |
| JP | 2005-242303 | 9/2005 |
| JP | 2007-94326 | 4/2007 |
| JP | 2007-199679 | 8/2007 |
| JP | 2008-197237 | 8/2008 |

OTHER PUBLICATIONS

Notice of Allowance dated Feb. 14, 2012 received from the Japanese Patent Office from related Japanese Application No. 2009-197211.

* cited by examiner

FIXING DEVICE

CROSS-REFERENCE TO RELATED APPLICATION

This application claims priority under 35 U.S.C. §119 from Japanese Patent Application No. 2009-197211 filed on Aug. 27, 2009. The entire subject matter of the application is incorporated herein by reference.

BACKGROUND

1. Technical Field

The following descriptions relate to a fixing device provided with a heat roller and a noncontact thermistor to detect a surface temperature of the heat roller.

2. Prior Art

Conventionally, as a fixing device for an electrophotographic image forming apparatus employing toner to develop a visual images, one using a heat roller and a noncontact thermistor to detect a surface temperature of the heat roller has been known.

SUMMARY OF THE INVENTION

Depending on a structure of a fixing device, the air heated by the heat roller may not flow to the thermistor sufficiently. In such a case, the temperature detected by the thermistor may be lower than the actual surface temperature of the heat roller. In other words, depending on the structure of the fixing device, the surface temperature of the heat roller may not be accurately detected with use of the noncontact thermistor.

In consideration of the above problem, aspects of the invention are advantageous that there is provided a fixing device for an electrophotographic image forming apparatus, which device is provided with a heat roller configured to heat a toner image formed on a sheet, and a thermistor arranged oppositely to a circumferential surface of the heat roller and configured to indirectly detect a temperature of the circumferential surface of the heat roller by detecting a temperature of the air in the vicinity of the heat roller, without contacting the heat roller. The thermistor is located at a position above a horizontal plane including a rotational axis of the heat roller and on a downstream side, in a rotational direction of the heat roller, with respect to a vertical plane including the rotational axis of the heat roller, and closer to the vertical plane than the horizontal plane.

BRIEF DESCRIPTION OF THE ACCOMPANYING DRAWINGS

DETAILED DESCRIPTION OF THE EMBODIMENT

Hereinafter, referring to the accompanying drawings, an embodiment according to aspects of the invention will be described.

Figure 1:
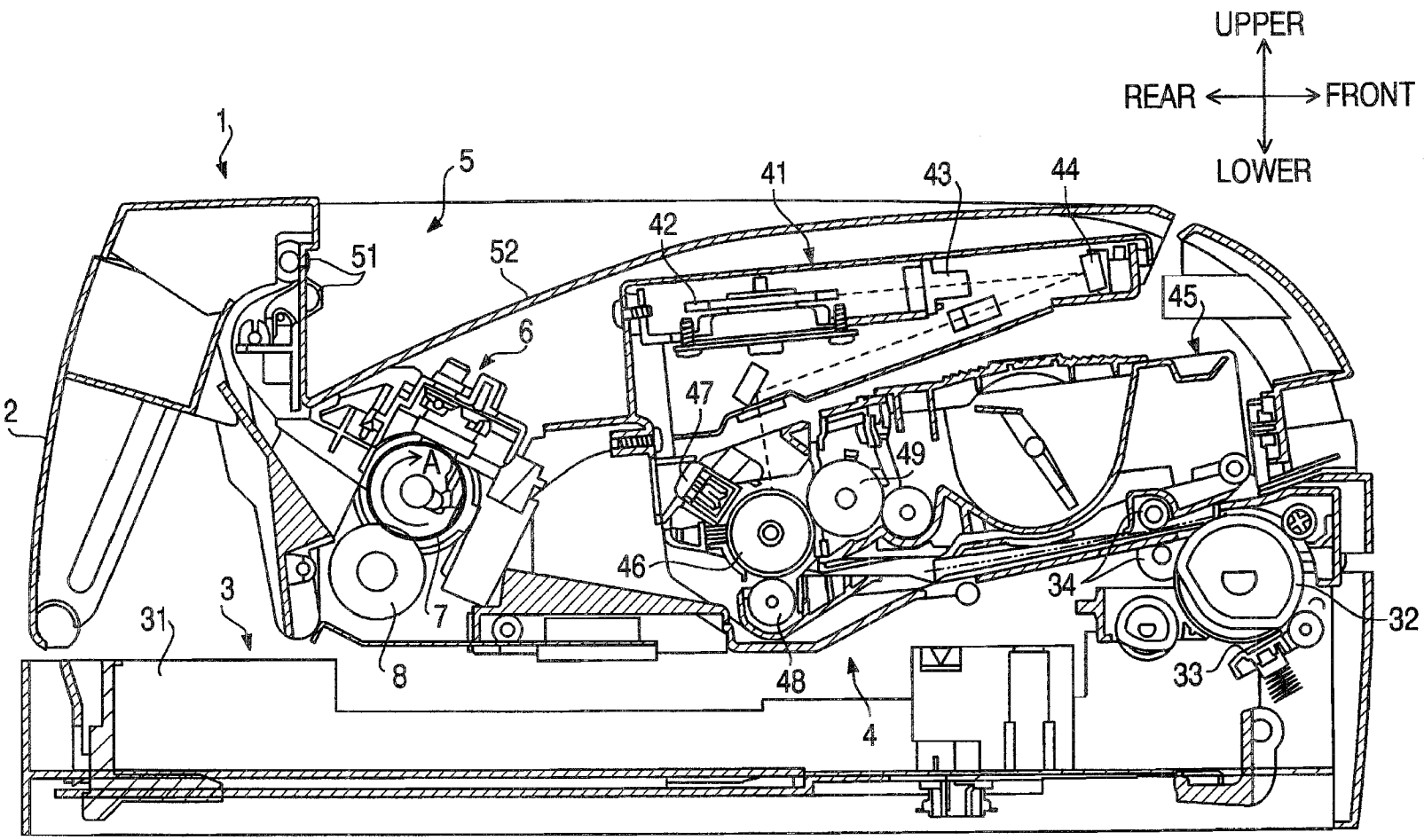
FIG. 1 shows a cross-sectional side view schematically showing a configuration of a color laser printer according to aspects of the invention.

A laser printer 1 shown in FIG. 1 has a casing 2, which accommodates a sheet feed unit 3, an image forming unit 4 that forms an image on a sheet fed from the sheet feed unit 3 according to an electrophotographic image formation method, and an ejected sheet tray 5 that receives sheets on which images are formed and which are ejected from the laser printer 1.

The sheet feed unit 3 is provided with, at a lower portion of the casing 2, (1) a sheet feed tray 31 that accommodates a stack of sheets, (2) a sheet feed roller 32 provided at an upper front portion of the sheet feed tray and configured to feed the sheets accommodated in the sheet feed tray 31, (3) a sheet feed pad 33 provided opposed to the sheet feed roller 32 to separate the sheets so that one sheet is fed at a time, and (4) registration rollers 34 configured to further feed the sheet fed from the sheet feed roller 32.

With the above configuration, the sheets accommodated in the sheet feed tray 31 is fed to the image forming unit 4 one by one.

The image forming unit 4 has a scanning module 41 that emits a scanning and modulated laser beam onto a photoconductive drum 46 to form an electrostatic latent image, a process cartridge 45 configured to transfer a toner image onto a sheet, and a fixing module 6 which fixes the toner image transferred onto the sheet by applying heat.

A scanner module 41 is provided at an upper portion of the casing 2 and includes a laser source (not shown), a polygonal mirror 42, a lens 43 and a reflector 44.

The laser beam, which is emitted by the laser source, is modified based on image data, and is scanned at a high speed by the polygonal mirror 42, and is incident on the photoconductive drum 46 via the lens 43 and reflector 44.

The process cartridge 45 is provided below the scanner module 41 and above the sheet feed module 3, and is configured to be detachably coupled with the casing 2. The process cartridge 45 includes the photoconductive drum 46, a charger 47 which electrifies the photoconductive drum 46, a transfer roller 48 configured to transfer a toner image formed on the circumferential surface of the photoconductive drum 46 to the sheet, and a developing roller 49 configured to supply toner to the photoconductive drum 46.

An image is formed as described below. Firstly, the circumferential surface of the photoconductive drum 46 is uniformly charged with the charger 47. Then, the charged surface of the photoconductive drum 46 is exposed to the scanned laser beam which has been modified based on the image data. As the electrical potential of the portions where the laser beam is incident is lowered, an electrostatic latent image is formed on the photoconductive drum 46. Thereafter, the toner supplied from the developing roller 49 is attracted by the portion where the latent image is formed (i.e., a toner image is formed). The thus formed toner image is transferred to the sheet. Specifically, as the photoconductive drum 46 rotates, a portion of the toner image is located at a position opposing to the sheet, and transferred to the sheet by the transfer bias applied to the transfer roller 48.

The fixing module 6 is arranged on a downstream side, in a sheet feed direction, with respect to the process cartridge 45. The fixing module 6 includes a heat roller 7 and a press roller 8, which is biased toward the heat roller 7. The heat roller 7 is configured to rotate in direction A (see FIG. 1) by a driving force transmitted for a motor (not shown). The press roller 8 is driven to rotate as the heat roller 7 rotates. The sheet fed from the process cartridge 45 is caught by a nip formed between the heat roller 7 and the press roller 8, which feed the with nipping the same therebetween.

The ejection module 5 has an ejection roller 51 configured to feed the sheet passed through the fixing module 6, and an ejected sheet tray 52 configured to receive the sheets fed by the ejection roller 51 in an stacked manner.

Next, the configuration of the fixing module 6 will be described in detail.

Figure 2:
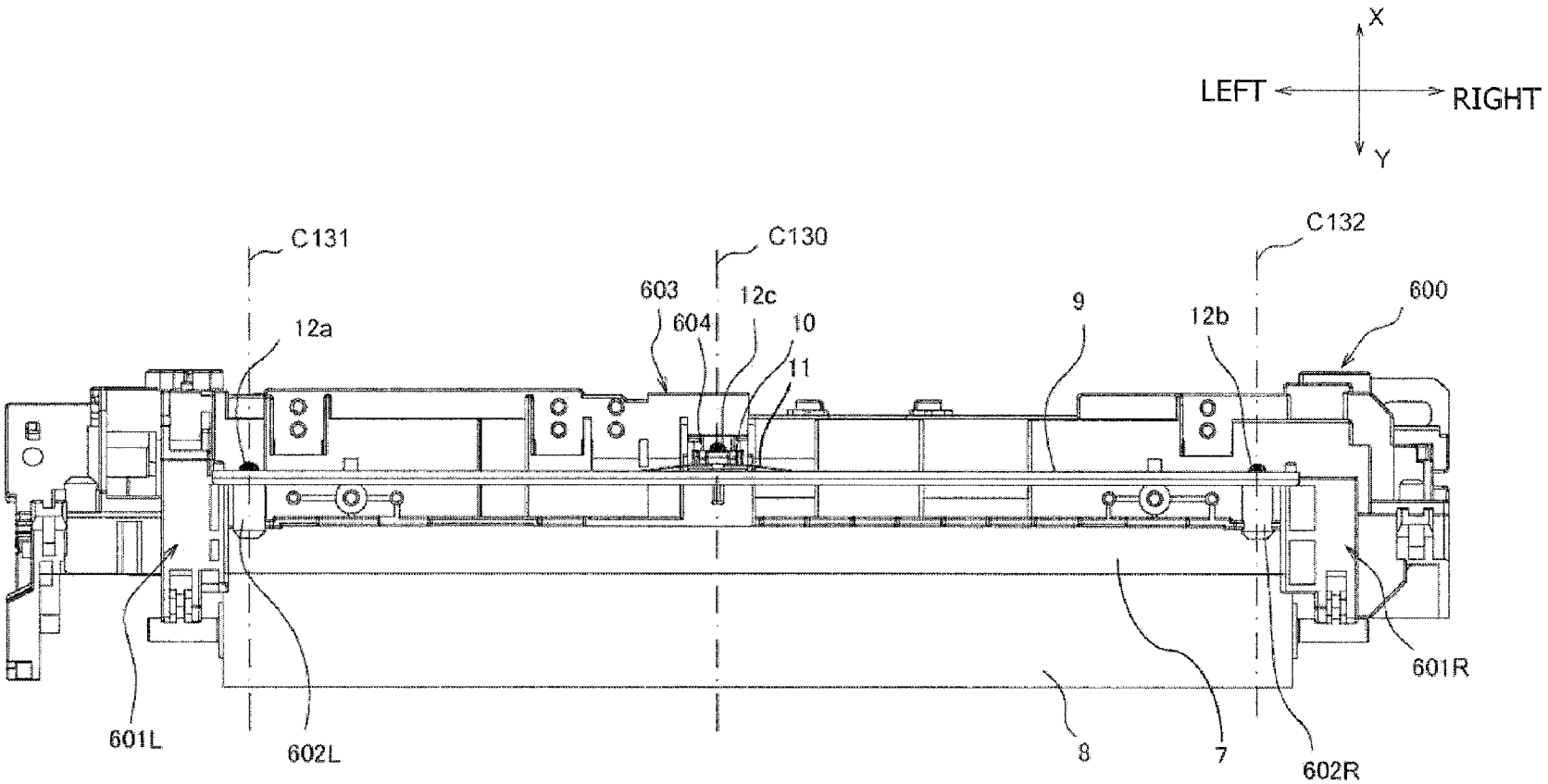
FIG. 2 is an inclined front view showing a fixing unit according to aspects of the invention.

The fixing module 6 includes, as described above, the heat roller 7 and the press roller 8. Further, the fixing module 6 includes, as shown in FIG. 2, a frame 600 that supports the heat roller 7 and the press roller 8, and a temperature detector 10 configured to detect the surface temperature of the heat roller 7, and a supporting member 9 that supports the temperature detector 10.

The frame 600 will be describe in detail. In the following description, a direction in which an axial line C130 of an adjusting screw hole 92 extends will be referred to as an X-Y direction (see FIG. 3).

The frame 600 has a stationary sections 601 at both ends in the direction where the rotational axis of the heat roller 7 extends, and a covering section 603 bridging between and integrally formed with the stationary sections 601. In the following description, the stationary sections 601 will be referred to as a left-side stationary section 601L and a right-side stationary section 601R as shown in FIG. 2. It should be noted that the terms "right" and "left" above corresponds to the right-hand side and the left-hand side of FIG. 2, respectively.

On the right-side stationary section 601R, a right-side securing screw hole 602R is formed. By inserting a right-side securing screw 12*b* through the right-side securing screw hole 602R, a supporting member 9 and the frame 600 are secured. Specifically, the right-side securing screw hole 602R is formed with a screw, with which the right-side securing screw 12*b* is screwed-engaged. Similarly, a left-side securing screw hole 602L is formed on the left-side stationary section 601L, and the frame 600 and the left-side stationary section 601L are secured with each other with a left-side securing screw 12*a* which is screw-engaged with the left-side securing screw hole 602L.

Figure 4:
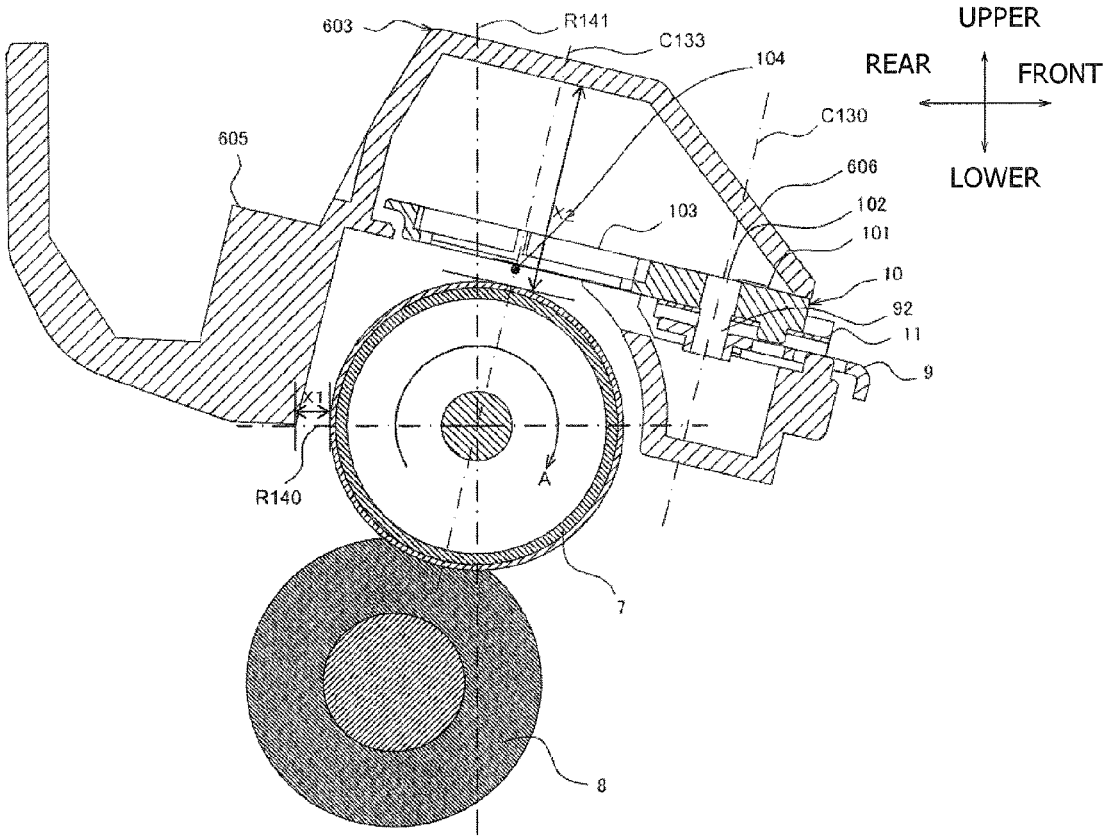
FIG. 4 is a cross-sectional view of the fixing device taken along line B-B in FIG. 3.

The covering section 603 is formed with a temperature detector mounting portion 604, on which the temperature detector 10 is mounted. As shown in FIG. 2, the temperature detector mounting section 604 is formed substantially at a central portion (in right-and-left direction in FIG. 2). The covering section 603 includes, as shown in FIG. 4, a first frame 605 which is above a horizontal plane R140, which includes a rotational axis of the heat roller 7, and covers the surface of the heat roller 7 on the upstream side, in the rotational direction, of the heat roller 7, with respect to a vertical plane R141 including the rotational axis of the heat roller 7, and a second frame 606, which is above the horizontal plane R140 and covers the surface of the heat roller 7 on the downstream side, in the rotational direction, of the heat roller 7, with respect to the vertical plane R141.

A distance X1 between an end of the first frame 605, on the upstream side in the rotational direction of the heat roller 7, and the surface of the heat roller 7 opposing to the end of the first frame 605 is shorter than a distance X2 which is a distance between a portion of the second frame 606 where a normal line C133 (described later) passes and the surface of the heat roller 7 at a position where the normal line C133 passes (see FIG. 4).

Figure 3:
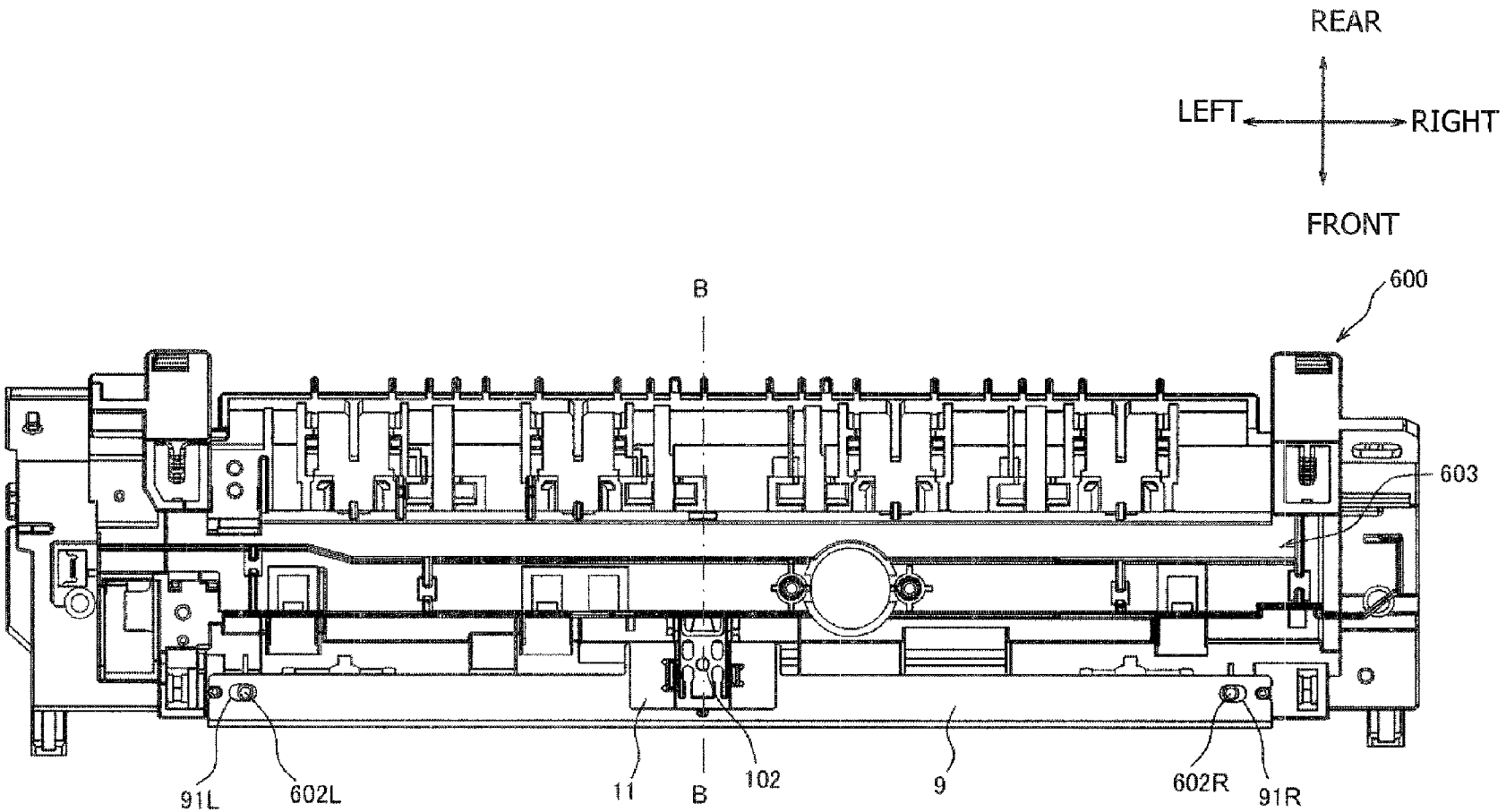
FIG. 3 is a plan view, corresponding to FIG. 2, of the fixing unit according to aspects of the invention.

The supporting member 9 is a plate member formed of steel such as stainless steel. As shown in FIGS. 3 and 4, the supporting member 9 has a right screw hole 91R and a left screw hole 91L through which a right securing screw 12*b* and a left securing screw 12*a* are inserted, respectively, and an adjustment screw hole 92 through which an adjustment screw 12*c* is inserted for securing the temperature detector 10 to the supporting member 9 and adjusting its position. The screw holes 91R, 91L and 92 are formed on a same plane.

The left screw hole 91L is arranged to correspond to the left-side securing screw hole 602L, and the right screw hole 91R is arranged to correspond to the right-side securing screw hole 602R.

The adjustment screw hole 92 is formed at the center, in the right-and-left direction, of the supporting member 9. The adjustment screw hole 92 is threaded. An axis C130 of the adjustment screw hole 92 is parallel with an axis C131 of the left-side securing screw hole 602L and an axis C132 of the right-side securing screw hole 602R (see FIG. 2).

The temperature detector 10 is a noncontact temperature sensor and configured to detect the surface temperature of the heat roller 7 based on the atmospheric temperature inside the frame 600. The temperature sensor 10 has a proximal end portion 101 which is supported by the supporting frame 9, and an attachment portion 103 protruded from the proximal end portion 101.

The proximal end portion 101 has a through hole 102 through which the adjustment screw 12*c* is inserted. To the attachment portion 103, a thermistor 104 for detecting the temperature of the heat roller 7 is attached.

The thermistor 104 is arranged at a position which is above the horizontal plane R140 which includes the rotational axis of the heat roller 7 and on the downstream side, in the rotation direction of the heat roller 7, with respect to the vertical plane R141 which includes the rotational axis of the heat roller 7, and closer to the vertical plane R141 than the horizontal plane R140. Further, the thermistor 104 is arranged such that the normal line C133 to the surface of the heat roller 7 at a position opposite to the thermistor 104 is parallel with the axis C130 of the adjustment screw hole 92 formed on the supporting member 9.

Between the supporting member 9 and the proximal end portion 101 of the temperature detector 10, a plate spring which biases the proximal end portion 101 upward is provided. The plate spring 11 is made of steel, and bent to form a trapezoid as shown in FIG. 2. On the upper surface of the plate spring 11, the proximal end portion 101 is mounted. Further, on the upper surface of the plate spring 11, a through hole 111 through which the securing screw 12*c* is inserted is formed.

The proximal end portion 101 and the plate spring 11 are secured on the supporting member 9 by inserting the securing screw 12*e* through the through hole 102 of the proximal end portion 101 and the through hole 111 of the plate spring, and fastening to engage with the adjustment screw hole 92 of the supporting member 9.

The proximal end portion 101 and the plate spring 11 are secured onto the supporting member 9 with the securing screw 12*c* as described above. As the securing screw 12*c* presses the plate spring 11 against the upward biasing force of the plate spring 11, the proximal end portion 101 is positioned in the X-Y direction and right-and-left direction with respect to the supporting member 9. In this state, the right-side securing screw 12*b* is inserted in the through hole 91R of the supporting member 9 and engaged with the right-side screw hole 602R of the right-side securing portion 601R. Similarly, the left-side securing screw 12*a* is inserted in the through hole 91L of the supporting member 9 and engaged with the left-side screw hole 602L of the left-side securing portion 601L. Since the securing screws 12*a* and 12*b* are screw-engaged in the screw holes 602R and 602L, respectively, the supporting member 9 is fixedly secured. As a result, a positioning of thermistor 104 with respect to the heat roller 7 in the right-and-left direction and front-and-rear direction can be achieved.

Next, an adjustment of the distance between the thermistor 104 and the surface of the heat roller 7 in the X-Y direction is performed. That is, by rotating the securing screw 12*c*, the thermistor 104 moves in the direction of the axis C130 of the adjustment screw hole 92 in accordance with or against the biasing force of the plate spring 11.

According to the embodiment, since the thermistor 104 is located above the horizontal plane R140 including the rotational axis of the heat roller 7 and on the downstream side, in the rotational direction of the heat roller 7, with respect to the vertical plane R141 including the rotational axis of the heat roller 7, and further the thermistor 104 is arranged closer to the vertical plane R141 than the horizontal plane R140, even if the heated air flows toward the downstream side from the heat roller 7 when it rotates, the thermistor 104 detects the surface temperature of the heat roller 7 accurately.

Further, since the distance X1 between the end portion of the first frame 605 and the heat roller 7 on the upstream side, in the rotational direction, of the heat roller 7 is shorter than the distance X2 between the portion of the second frame 606 at which the normal line C133 passes and the surface of the heat roller 7, the air is prevented from entering through a space between the end portion of the first frame 605 and the surface of the heat roller 7. With this configuration, detection of the temperature by the thermistor is not effected by the air entering from outside. Therefore, the surface temperature of the heat roller 7 can be detected accurately.

Still further, according to the embodiment, since the axes C1130-C133 are parallel to each other, when the distance between the heat roller 7 and the thermistor 7 is adjusted by rotating the adjustment screw 12*c*, the thermistor 7 moves along the axis C130, which is the axis of the adjustment screw hole 92, therefore, the distance between the thermistor 104 and the surface of the heat roller 7 can be adjusted with high accuracy.

According to the embodiment, the through holes 91R and 91L, and the adjustment screw hole 92 are formed on the same plane of the supporting member 9. Therefore, the temperature detector 10 can be secured on the frame 600 with keeping the temperature detector 10 parallel with the plane of the supporting member 9. That is, the supporting member 9 is not bent for securing the temperature detector 10 on the supporting member 9. Therefore, there is no dimensional error due to bending of the supporting member 9. Thus, regardless of the configuration of the supporting member 9, the distance between the thermistor 104 and the surface of the heat roller 7 can be adjusted accurately and easily.

What is claimed is:

1. A fixing device for an electrophotographic image forming apparatus, comprising:

a heat roller configured to heat a toner image formed on a sheet;

a thermistor arranged oppositely to a circumferential surface of the heat roller and configured to indirectly detect a temperature of the circumferential surface of the heat roller by detecting a temperature of the air in the vicinity of the heat roller, without contacting the heat roller;

a supporting member having a planar plate-like shape and configured to support the thermistor; and a frame member on which the supporting member is fixed, wherein the thermistor is located at a position above a horizontal plane including a rotational axis of the heat roller and on a downstream side, in a rotational direction of the heat roller, with respect to a vertical plane including the rotational axis of the heat roller, and closer to the vertical plane than the horizontal plane;

wherein the supporting member has a securing hole used to secure the supporting member onto the frame member with a securing screw, and an adjusting hole with which an adjusting screw is threaded to adjust a position of the thermistor, wherein the securing hole and the adjusting hole are formed on a same plane of the supporting member, and a normal line to the circumferential surface of the heat roller at a position opposite to the supporting member, an axial line of the securing hole, and an axial line of the adjusting hole are parallel with each other, and wherein the securing screw and the adjusting screw are respectively threaded to the securing hole and the adjusting hole from the same direction with respect to the same plane of the supporting member.

2. The fixing device according to claim 1, wherein the frame member has:

a first frame configured to cover the heat roller at a portion above the horizontal plane and on an upstream side, in the rotation direction of the heat roller, with respect to the vertical plane;

a second frame configured to cover the heat roller at a portion above the horizontal plane and on a downstream side, in the rotation direction of the heat roller, with respect to the vertical plane, wherein a distance between the first frame and the circumferential surface of the heat roller is smaller than a distance between the second frame and the circumferential surface of the heat roller.

3. The fixing device according to claim 2, wherein the supporting member comprising a steel plate which is bent along a line parallel with a rotational axis of the heat roller.

4. The fixing device according to claim 1, further comprising a frame member arranged above the horizontal plane and on a downstream side of the thermistor in the rotation direction of the heat roller, the frame member facing the circumferential surface of the heat roller.

5. The fixing device according to claim 1, further comprising a pressure member configured to sandwich, together with the heat roller, the sheet to contribute to feeding of the sheet, the pressure member being arranged on the downstream side, in the sheet feed direction, with respect to the vertical plane.

6. The fixing device according to claim 5, wherein the pressure member comprises a pressure roller, a rotational axis of the pressure roller is located on the downstream side, in the sheet feed direction, with respect to the vertical plane.

7. The fixing device according to claim 1, further comprising an attachment portion configured to locate the thermistor at the position above the horizontal plane, the attachment portion having a bottom surface facing downward and inclined with respect to the horizontal plane.

* * * * *